US005526742A

United States Patent [19]

Petersen

[11] Patent Number: 5,526,742

[45] Date of Patent: Jun. 18, 1996

[54] METHOD AND APPARATUS FOR MULTICOLOR PRINTING, PARTICULARLY ON TEXTILES

[76] Inventor: Poul S. Petersen, Broerupvej 71, Kattrup, DK-8732, Hovedgaard, Denmark

[21] Appl. No.: 104,110

[22] PCT Filed: Feb. 15, 1991

[86] PCT No.: PCT/DK91/00047

§ 371 Date: Sep. 23, 1993

§ 102(e) Date: Sep. 23, 1993

[87] PCT Pub. No.: WO92/14610

PCT Pub. Date: Sep. 3, 1992

[51] Int. Cl.[6] ..... B41M 1/12

[52] U.S. Cl. ..... 101/129; 101/487; 101/211

[58] Field of Search ..... 101/487, 488, 101/114, 115, 123, 129, 211

[56] References Cited

U.S. PATENT DOCUMENTS

| | | | |
|---|---|---|---|
| 2,329,152 | 9/1943 | Breyer | 101/488 |
| 2,484,671 | 10/1949 | Bauman | 101/115 |
| 3,141,408 | 7/1964 | Bernardi et al. | 101/488 |
| 4,920,881 | 5/1990 | Tafel | 101/488 |
| 5,136,938 | 8/1992 | Pellegrina | 101/488 |

FOREIGN PATENT DOCUMENTS

| | | |
|---|---|---|
| 2209498 | 9/1973 | Germany . |
| 2344376 | 3/1974 | Germany . |
| 2944560 | 5/1981 | Germany . |
| 1489593 | 10/1977 | United Kingdom . |
| 1535856 | 12/1978 | United Kingdom . |

*Primary Examiner*—Eugene H. Eickholt
*Attorney, Agent, or Firm*—Watson Cole Stevens Davis

[57] ABSTRACT

A method and apparatus are provided for successive application of printing dyes to textiles and other sheet materials. The printing dyes are cooled in separate and successive printing stations and a direct contact may be provided between a cooling surface and a printing dye which has been applied in a previous station. A fixation of the printing dye is ensured and the surface tension is reduced, whereby the printed material is of high quality without smearing of dyes and without the risk of wet dyes adhering to the printing form in a succeeding printing station.

17 Claims, 4 Drawing Sheets

METHOD AND APPARATUS FOR MULTICOLOR PRINTING, PARTICULARLY ON TEXTILES

BACKGROUND OF THE INVENTION

The present invention relates to a method for multicolor printing, preferably textile printing wherein the printing dyes are applied successively, preferably in mutually independent and separate printing stations in which each of the viscous printing dyes are cooled in order to obtain a non-viscous or set-off free condition before and during the application of the succeeding printing dye.

The term printing refers to the methods of printing in which a printing surface which does not necessarily have to consist of a textile material, but which can also consist of paper or similar materials, is provided with a multicolor print by successively leading the material to be printed through a number of printing stations in each of which a printing dye is applied, e.g. through a seri-graphical printing frame. The printing machine operates according to a seri-graphical principle, i.e. either by means of a roller-printing principle or a flat-printing principle.

For this purpose a number of various printing machines have been developed in which the materials to be printed are placed on supporting plates which are led along a number of printing stations in which a printing form is applied to the printing surface onto which the printing dye desired is applied. Furthermore, the printing station comprises a printing mechanism which is activated in order to print the pattern and the color which is special for each of the printing stations. Generally, 2–8 printing stations are in question. It is noted that the printing forms can be circular or planar.

The dyes used are generally rather viscous and they are applied in rather thick layers.

In order to achieve a relatively fast printing sequence a cooling technique may be used, e.g. similar to the one descibed in DE patent No. 2,944,560. Thus it becomes possible to obtain a stabilization of the printing dye between succeeding applications of different printing dyes. Such stabilization or fixation of the dyes is necessary in order to avoid the dyes mixing with one another. When cooled, it is possible to stabilize the printing area in such a way that the previously printed printing color before and during the application of the succeeding dye appears as a non-viscous or set-off free dye, thus avoiding any damage during its passage through the succeeding printing station.

However, by the known methods in which the printing color is fixed by cooling, the production capacity will be limited due to the isolating effect taking place through the material when a cooling is performed from the underside of the material. Accordingly, e.g. GB-A-1,489,593 discloses a method in which cooling is effected directly by means of a coolant which is sprayed directly onto the surface of the printing dye. However, this method gives a limited effect and the quality is not satisfying in all printings.

SUMMARY OF THE INVENTION

It is the object of the present invention to provide a method of the above-mentioned type permitting a cooling fixation and a simultaneous high printing sequence as well as a high-quality printing with a minor risk of dye setting-off during the succeeding application of printing dye. According to the invention this is achieved by means of a method which is characterized in that a direct contact is provided between the printing dye and the cooling means by bringing the printing dye in contact with a cooling plate, said contact at least ensures a fixation as well as a reduction of the surface tension of the printing dye.

Due to the contact cooling an instant and quick freezing process takes place. Thus, it is possible to maintain a high printing sequence. Furthermore, a substantial drop in the surface tension of the dye will be achieved thus minimizing the adherence or set-off of the printing dye in a succeeding printing station. In this way the applied printing dye will pass unsmeared through one or several succeeding printing stations.

E.g. the contact cooling may take place by means of a circular or planar cooling plate whereby the surfaces of the print are smoothed.

By means of contact cooling, an instant so-called shell-freezing takes place and a sub-cooling of the upper layer of the printing dye, when the temperature of the cooling means is substantially below the freezing point or the glass point temperature of the printing dye. Thus a better quality of the print is achieved without reducing the printing sequence. After the material has been led through a printing machine the dyes can be defrozen and fixed in a manner known per se through heating and vaporization of the liquid contained in the printing dye in a conventional fixation oven. This operation can take place without reducing the quality of the print.

In order to achieve a sufficient low temperature, liquids may be used which have a boiling point temperature below the freezing or glass point temperature of the dye used and as examples of coolants nitrogen or freons can be mentioned which are applied either by means of direct application of the gas and/or are applied direct to the printing dye or by cooling through a CFC-cooled or nitrogen cooled heat exchanger whose cooling plate is in contact with the printing dye.

When printing is performed directly on textiles a print having better quality will be achieved by using the direct contact with the cooling plate levelling than would have been achieved otherwise. This is due to the fact that the surface of the printed motive will appear as a smooth surface with the result that the colors will be much brighter due to less diffusion of the light reflected from the color print.

Under certain circumstances a thicker layer of dye is desired. This may e.g. be the case when a better covering layer is desired or in cases where it is of advantage to reprint on top of the previous cooled/frozen print due to the profiling of the color print or for other reasons. In these cases it would be of advantage to influence the freezing point on the succeeding dye, e.g. by means of adding alcohol. Thus, the freezing point or the glass point temperature of the dye can be changed and the cold from the previously applied printing dye can be prevented from causing the succeeding layer to freeze during application.

It is to be noted that the above-mentioned technique should be adjusted according to specific circumstances in the actual production, however, the method can be adapted when manufacturing printing machines with standard equipment permitting the cooling capacity required and a simultaneous maintenance of a high printing sequence.

Furthermore, the invention relates to a printing machine for use in the above-mentioned method comprising a number of printing stations and printing material carriers which are arranged to bring the material to be printed from station to station successively, and cooling means which are arranged to bring a dye, which has been applied in a printing station, to a non-viscous or set-off free condition before and during the application of the succeeding printing dye in a succeeding printing station, characterized in that the cooling means comprise a cooling plate which is arranged for direct contact with the applied printing dye.

In such printing machines, the cooling means may be embodied in different ways in order to obtain the advantages which are associated with the above-mentioned method. Thus the cooling means may consist of a cooling plate which in a manner known per se is cooled to a temperature below the freezing point or glass point temperature of the dye used. The printing machine may be constituted by a co-called printing wheel which is illustrated in FIG. 1. It may also be constituted of a printing machine in which an elongate length of material is fed through the printing stations. In this case the printing material carriers will only be constituted of a part of the elongate length of material.

BRIEF DESCRIPTION OF THE DRAWINGS

The invention will now be further explained with reference to the accompanying drawing, wherein FIG. 2–7 shows partial views of various embodiments of the printing illustrating various methods for application of the printing dye.

DETAILED DESCRIPTION OF THE INVENTION

By way of introduction it is noted that the printing stations in the embodiment illustrated in FIGS. 2–6 may optionally be used in both machines with roller printing principle and in machines with plane printing principle.

Figure 1:
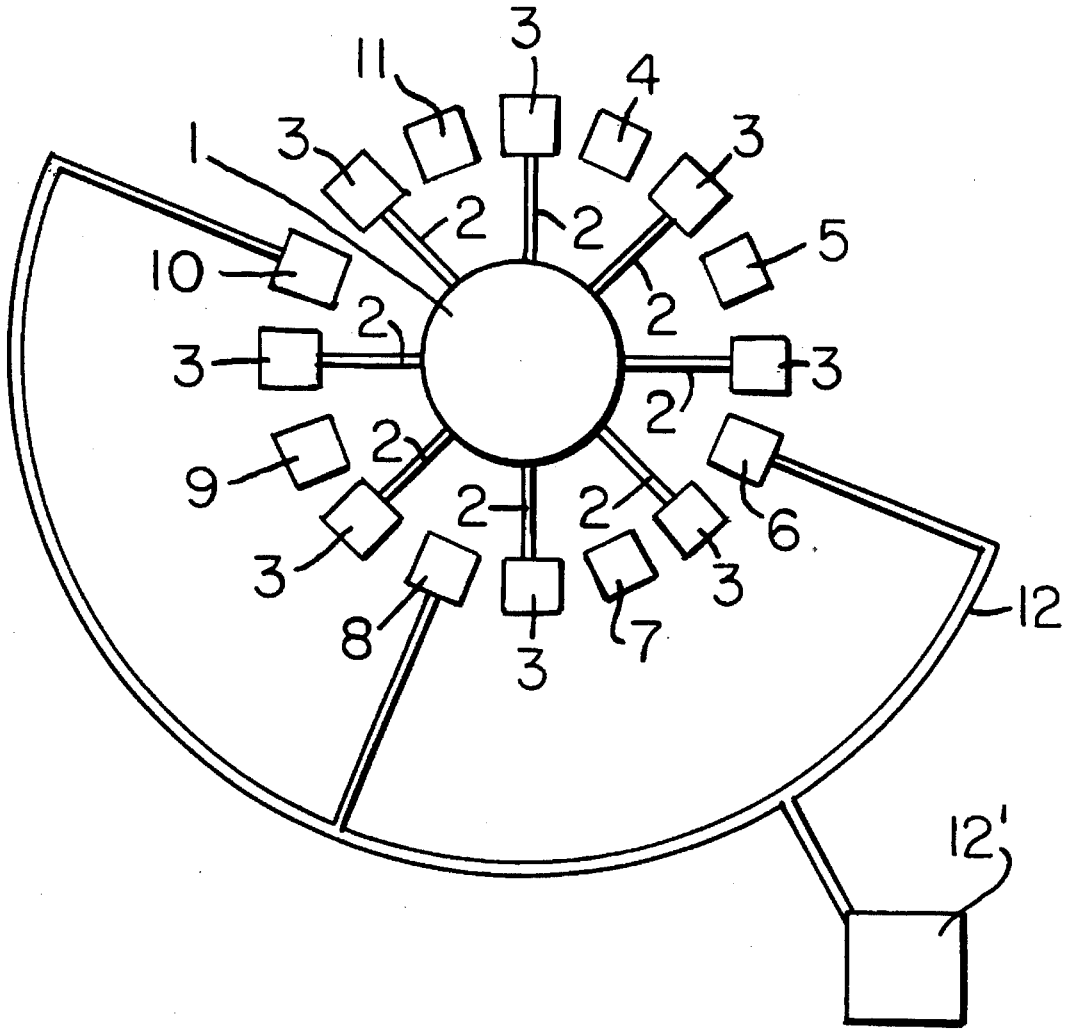
FIG. 1 shows a view as seen from above of the fundamental construction of a printing machine according to the invention.

FIG. 1 illustrates a printing wheel known to a skilled person in the art. The printing wheel has a central part 1 with radially extending arms 2. At the distal end of each arm 2, a vertical printing plate 3 is arranged. In the embodiment shown the printing wheel has eight printing plates 3 and these can be moved through eight succeeding stations. These stations have been designated 4–11 and 4 designates the first station for the introduction of printing materials and 11 designates the final station for the removal of printing materials while 5–10 illustrate six intermediate stations in which printing and cooling are performed, alternatively. Cooling and printing are performed simultaneously. Any number of appropiate printing plates and printing stations can be used. In FIG. 1 the printing plates 3 are shown in a position between the stations 4–11 during the rotation between two succeeding prints/coolings.

The materials to be printed, e.g. pieces of textile, are introduced onto the printing plates 3 in the first station 4, then in each of the stations 5–10 application of individual dyes in the desired printing patterns and cooling of the applied printing dyes is effected alternatively preferably in seri-graphical printing. Eventually, the finished printed subjects are removed from the final station 11.

According to the invention cooling means 12 are arranged in every second station, i.e., 6, 8 and 10. Each of the cooling means 12 are connected to a coolant source 12' which can supply the stations with a coolant in order to cool down the printing dyes to obtain a non-viscous or set-off free condition before and during the application of a dye in the succeeding station, i.e., 5, 7, and 9.

In the following a more detailed explanation will be given on the various embodiments for the cooling means 12 used in the printing machine according to the invention.

Figure 2:
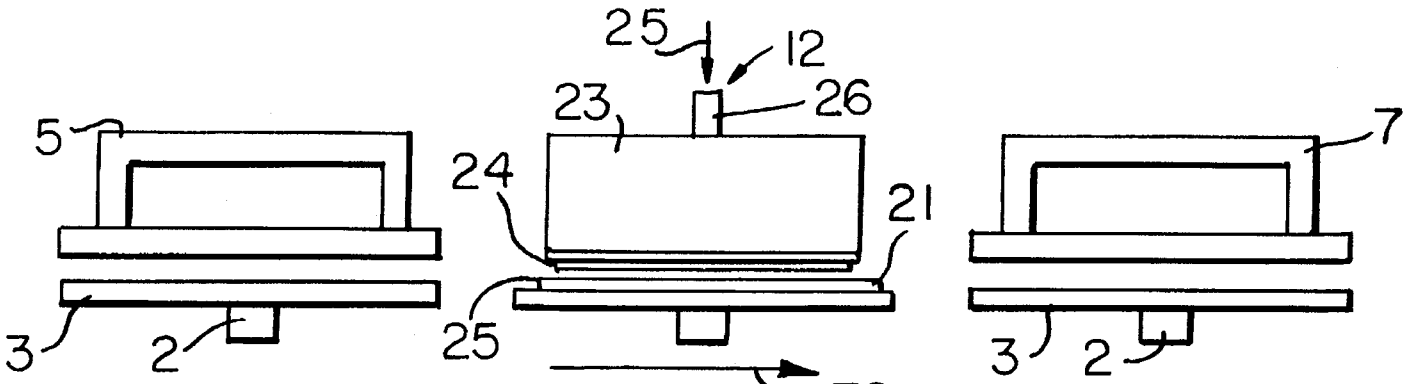

FIG. 2 illustrates an embodiment with separate printing material carriers corresponding to the ones illustrated in FIG. 1. FIG. 2 illustrates two randomly chosen printing stations 5,7 and between these the cooling means 12 are arranged. In this printing machine the number of desired printing dyes are applied stepwisely on a printing material 21. The printing dyes are designated 22. The cooling means 12 are constituted by a heat exchanger box 23 with a planar, lower cooling surface 24 intended for direct contact with the printing dye 22. In the heat exchanger 23 a cooling is performed by means of a cooling gas 25 which is applied via a pipe stub 26. In this way the temperature is lowered on the cooling plate 24 to a temperature causing the printing dye 22 to be fixed. In practice this embodiment is used by lowering the heat exchanger 23 down towards the printing plate 3 thus pressing the cooling plate 24 against the printing dye 22. Thus a simultaneous smoothing and freezing of the printing color is achieved.

According to the embodiment shown, a printing station is used for the heat exchanger 23. However, the heat exchanger 23 could also be embodied as a cylindrical or conical roller being brought into contact with the printing dye 22 by touching this during the operation of the printing machine in which the printing plates 3 are conveyed to a succeeding printing station for a subsequent printing sequence.

Figure 3:
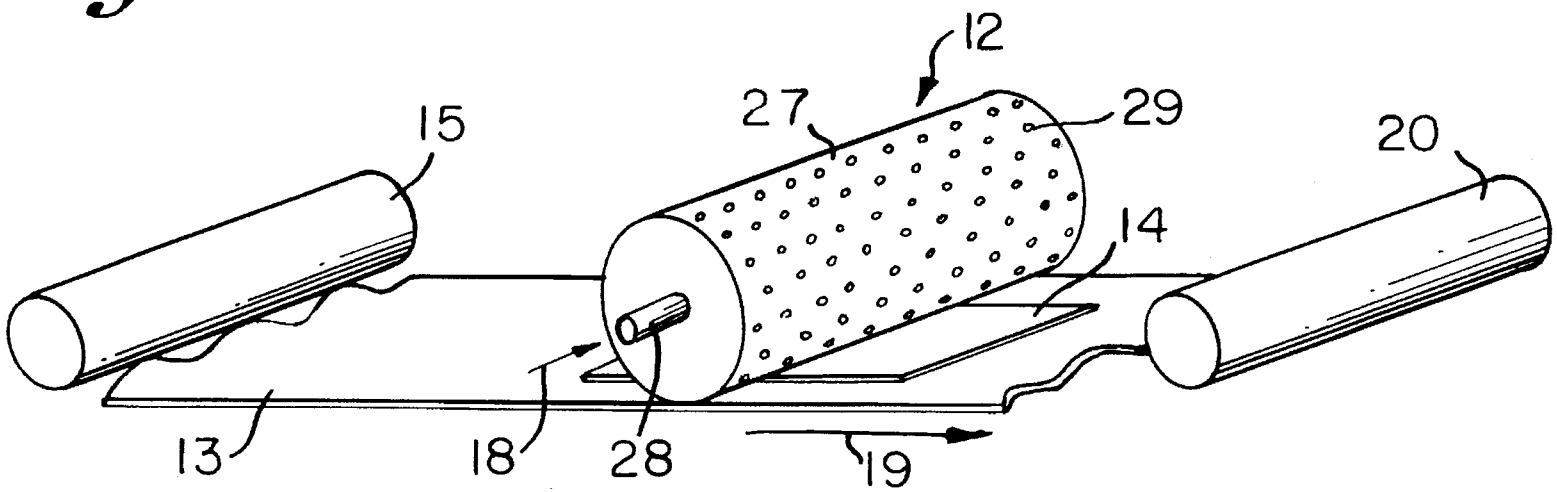

FIG. 3 illustrates a partial view of a further embodiment for a printing machine. FIG. 3 illustrates an elongate length of material 13 which is introduced through the printing machine by means of guide rollers (not shown). On the length of material 13 a printing dye 14 has been arranged in a previous printing station 15. In this embodiment the cooling means 12 are provided in the form of a perforated roller 27. Depending on the need for cooling different amounts of coolants 18 are applied as it is possible in this way to regulate the extension of the cooling zone in the longitudinal direction of the length of material. The length of material is moved in its longitudinal direction according to the direction indicator 19 and when passing through a succeeding printing station 20 the temperature the printing color 14 will have been cooled to is a temperature below the freezing or glass point temperature of the dye thus avoiding any smearing or set-off of dye on the printing form used in the succeeding printing station 20. The coolant 18 is conducted via a pipe stub 28. Thus a cooling of the printing dye 14 is established by means of a combination of direct contact pressure with the cooled perforated roller 17 and by means of direct contact with the coolant gas and/or liquid flowing through the perforations 29 of the roller 27. Thus an especially advantageous cooling and smoothing of the surface of the printing color are achieved simultaneously, permitting the extension of the cooling zone in the longitudinal direction of the length of material to be controlled through a variation of the supplied amount of coolant 18.

Figure 4:
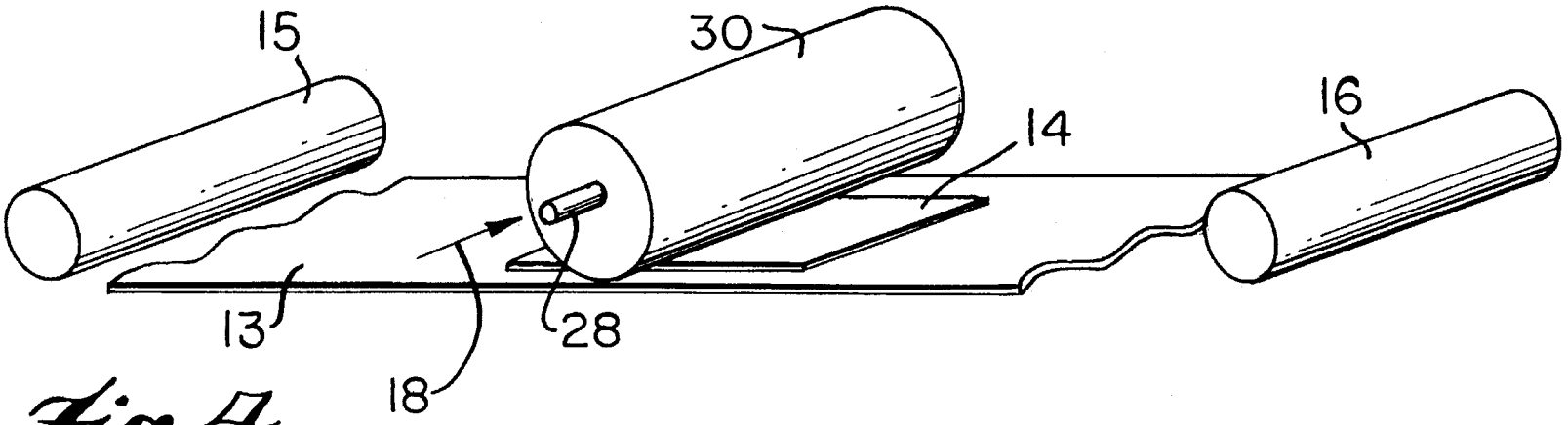

In FIG. 4 a partial view of a further embodiment is illustrated. This embodiment differs from the embodiment illustrated in FIG. 3 in the way that a closed roller 30 is used instead of a perforated roller. In the embodiment shown, the roller is cooled by means of a cooling medium supplied internally of the roller 30. The function of this embodiment corresponds to the function of the embodiment shown in FIG. 3.

Figure 5:
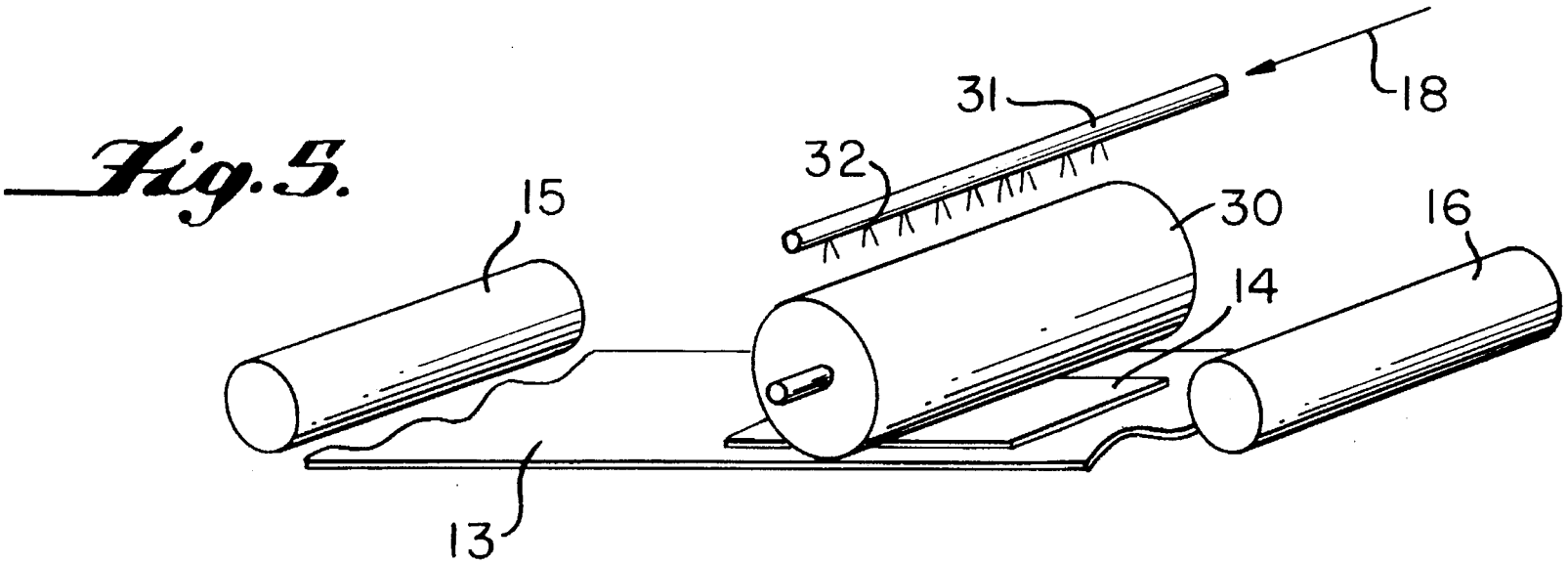

FIG. 5 illustrates a partial view of yet another embodiment for a printing machine according to the invention. The embodiment illustrated in FIG. 5 differs from the embodiment illustrated in FIG. 4 in the way that the closed roller 30 is cooled by using a lance 31 which is supplied with a coolant 18 which, via openings 32, is applied onto the surface of the roller thus cooling the surface to a sufficiently low temperature to cool the printing dye to a temperature at which it is non-viscous or set-off free.

In FIGS. 2–5 different embodiments are illustrated, however, it is to be noted that it will be possible to use any appropiate combination of these embodiments. E.g. it will be possible to add a coolant both to the inner side and the outer side of the roller.

Figure 6:
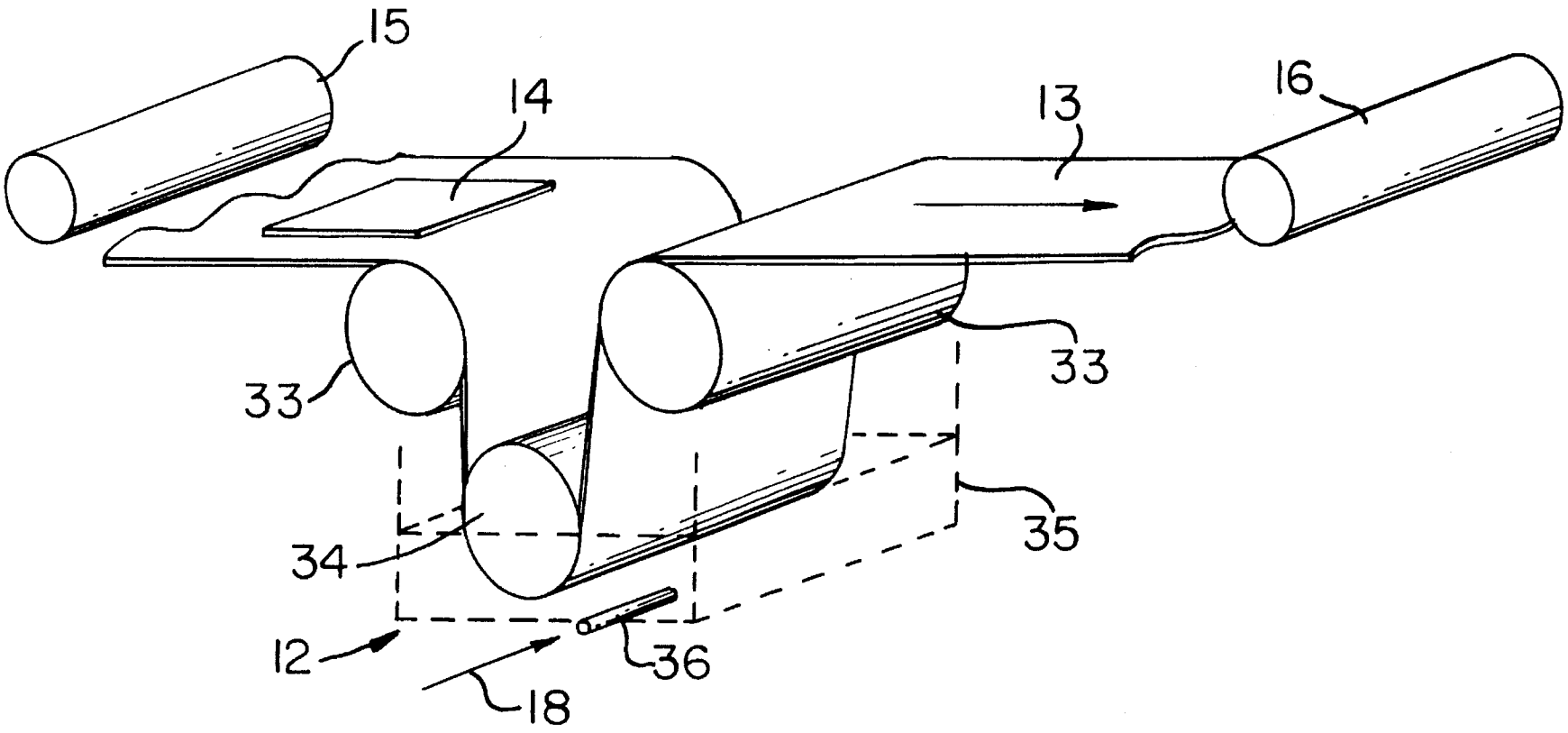

FIG. 6 shows a partial view of yet another embodiment for a printing machine in which the cooling means 12 are constituted of an arrangement of rollers 33,34 and a vessel 35 containing a liquid medium. The roller arrangement 33,34 and the vessel 35 are arranged between a succeeding printing station 15,16. The length of material 13 is conducted around a guide roller 33 down into the vessel containing a coolant, e.g. liquid nitrogen. The length of material with the applied dyes 14 is conducted around the roller 34 which has been partly dipped in the liquid nitrogen whereby cooling of the printing dyes takes place and simultaneously the dye is smoothed by the smooth roller 34. The length of material is hereafter conducted around another guide roller 33 to a succeeding printing station 16 in which no set-off will take place from the previously applied printing dye. The vessel 35 is provided with an inlet pipe stub 36 through which a dosing of the amount of coolant takes place and which is necessary in order to establish the desired cooling of the printing dye. Even though it has not been illustrated specifically, it is implied that the vessel 35 is isolated and that the length of material can pass into the vessel through very narrow slits at the top side of the vessel.

In the embodiment illustrated in FIG. 2 it will be possible to design the printing plates 3 as active freezing elements, thus achieving a better cooling. However, the indirect cooling obtained will not be able to give the same advantages as the direct contact freezing which is established directly on the printing dye. If the printing plates have been designed as freezing elements it has to be ensured that the temperature does not cause the printing forms used to freeze.

The present invention can be used in connection with multicolor printing of textiles, however, the invention can also be used in connection with application of printing dye onto other materials, e.g. paper and it will also be possible to use the invention in connection with transfer printing.

The printing dyes used may be water-based printing dyes, but also non-water-based printing dyes may be used.

In the embodiments illustrating lengths of materials 13, it is possible to use a supporting length upon which the materials to be printed are arranged. In principle, this will correspond to printing directly on the lengths of material.

I claim:

1. A method for multicolor printing, wherein a plurality of printing dyes are successively applied to a material at successive printing stations, said method comprising the steps of:

(A) introducing a material to be printed in a first printing station, (B) applying a printing dye onto a surface of the material introduced in the first printing station to form a printed surface, (C) cooling the printing dye applied in the first station by bringing the printed surface into direct contact with a cooling plate to fix the printing dye and reduce the surface tension of the printing dye, thus forming a printed material, (D) introducing the printed material into a successive printing station, (E) applying a successive printing dye onto the printed surface of the printed material in the successive printing station to form a successively printed surface, (F) cooling the successive printing dye by bringing the successively printed surface into direct contact with a cooling plate such that the successive printing dye is fixed to said material and the surface tension of the successive printing dye is reduced, thus forming a successively printed material, and (G) repeating steps (D) through (F) until the plurality of dyes has been applied to the material.

2. A method according to claim 1, wherein steps (B), (C), (D), (E) and (F) are performed simultaneously, at different stations.

3. A method according to claim 1, wherein the cooling plate is provided with perforations, and a cold gas is conducted through the perforations onto the printed surface.

4. A method according to claim 1, wherein said cooling plate is a hollow cooling roller and said step of cooling includes bringing the printed surface into direct contact with the hollow cooling roller and simultaneously conducting a coolant to the inner surface of the cooling roller.

5. A method according to claim 1, wherein said cooling plate is a cooling roller and said step of cooling includes bringing the printed surface into direct contact with the cooling roller and simultaneously conducting a coolant to the outer surface of the cooling roller.

6. A printing apparatus for multicolor printing wherein a plurality of printing dyes are successively applied onto a material to be printed in successive printing stations, said apparatus comprising:

a first printing station and a plurality of successive printing stations;

a plurality of printing material carriers, each of which being arranged to bring a material to be printed from one of said printing stations to one of said successive printing stations;

means for introducing a material into said first printing station;

means for applying a printing dye onto a surface of the material introduced in the first printing station to form a printed surface;

a plurality of cooling means each of which being arranged between two successive printing stations and comprising a cooling plate;

means for supplying coolant to each said cooling means;

means for bringing the cooling means into direct contact with the applied printing dye to cool the applied printing dye to a non-viscous state before the application of a successive printing dye onto the printed material;

means for introducing the printed material into each successive printing station;

means for applying a successive printing dye to the printed material to thus form a successive printed surface, wherein each cooling plate is associated with a successive printing station to cool a successively applied printing dye, and means for bringing each successive printed surface into direct contact with the associated cooling plate to fix the successive printing dye and to reduce the surface tension of the successive printing dye, thus forming a successive printed material.

7. A printing apparatus according to claim 6, wherein each cooling plate comprises a roller-shaped cooling plate rotatably arranged between successive printing stations.

8. A printing apparatus according to claim 6, wherein each cooling plate comprises a curved cooling plate arranged between successive printing stations.

9. A printing apparatus according to claim 6, wherein each cooling plate comprises a planar cooling plate arranged between successive printing stations.

10. A printing apparatus according to claim 6, wherein each cooling plate constitutes an integral part of a corresponding printing material carrier.

11. A printing apparatus according to claim 6, wherein each cooling plate constitutes an integral part of a corresponding printing station.

12. A printing apparatus for multicolor printing wherein a plurality of printing dyes are successively applied onto a material to be printed in successive printing stations, said apparatus comprising:

a first printing station and a plurality of successive printing stations, a plurality of cooling plates, one associated with each printing station, means for introducing a material to be printed into said first printing station, means for applying a printing dye onto a surface of the material introduced in the first printing station, means for cooling the printing dye applied in the first station including means for bringing the printed surface into direct contact with one of said plurality of cooling plates to fix the printing dye and to reduce the surface tension of the printing dye, thus forming a printed material, means for introducing the printed material into each successive printing station, means for applying a successive printing dye to the printed material to thus form a successive printed surface, wherein each cooling plate is associated with a successive printing station to cool successive printing dye, and means for bringing each successive printed surface into direct contact with the associated cooling plate to fix the successive printing dye and to reduce the surface tension of the successive printing dye, thus forming a successive printed material.

13. A printing apparatus according to claim 12, wherein each cooling plate comprises a roller-shaped cooling plate rotatably arranged between successive printing stations.

14. A printing apparatus according to claim 12, wherein each cooling plate comprises a curved cooling plate arranged between successive printing stations.

15. A printing apparatus according to claim 12, wherein each cooling plate comprises a planar cooling plate arranged between successive printing stations.

16. A printing apparatus according to claim 12, wherein each cooling plate constitutes an integral part of a corresponding printing material carrier.

17. A printing apparatus according to claim 12, wherein each cooling plate constitutes an integral part of a corresponding printing station.

* * * * *